United States Patent [19]

Carlyle

[11] Patent Number: 4,762,439

[45] Date of Patent: Aug. 9, 1988

[54] SECURITY BARRIER DEVICE

[76] Inventor: Martin P. Carlyle, 48, Reservoir Road, Erdington, Birmingham, England

[21] Appl. No.: 46,744

[22] Filed: May 7, 1987

[51] Int. Cl.[4] ..... E01F 13/00

[52] U.S. Cl. ..... 404/6; 404/11; 49/33; 49/35; 49/49; 49/131

[58] Field of Search ..... 404/6, 9–11; 49/33, 35, 49, 131

[56] References Cited

U.S. PATENT DOCUMENTS 3,956,853 5/1976 Montgomery ..... 49/131 X
4,332,503 6/1982 Hurst, Jr. ..... 404/11

FOREIGN PATENT DOCUMENTS 2850690 10/1986 France ..... 49/35
1478840 7/1977 United Kingdom ..... 404/6

*Primary Examiner*—Stephen J. Novosad
*Assistant Examiner*—John F. Letchford
*Attorney, Agent, or Firm*—Larson and Taylor

[57] ABSTRACT

A security barrier device comprises a rectangular container defined by sides, ends and a base. A post is mounted in the container for pivotal movement about a transverse pin with a slot in the post allowing linear movement of the post relative to the container. A recess in the base of the container allows the post to be latched in position in a vertical orientation and in addition the post can be stored by sliding out of the recess and then pivoting into a position lying along the container. A cover is provided by a first fixed part adjacent the pin and the second moveable part which is pivoted at the end of the container remote from the post and which is locked into engagement with a side of the post and a lug on the post by a locking mechanism welded to one side of the container.

6 Claims, 2 Drawing Sheets

SECURITY BARRIER DEVICE

BACKGROUND OF THE INVENTION

This invention relates to a security barrier device of a type which can be readily moved into position to prevent a vehicle entering a prohibited area.

Many different situations occur where it is desired or required to prevent vehicles entering a prohibited or restricted area. These occasions can vary from the minor nuisance situation where an unauthorized person improperly uses a reserved or allocated car parking space thus causing a problem for the authorized user, to criminal situations where a vehicle can be driven close to a building and articles or equipment stolen from the building under cover of the close proximity of the vehicle to the building. In other situations it is sometimes required that a roadway be closed for part of the time and open to allow access at other times.

In all of these cases it is desirable to have a barrier arrangement which can be simply and readily erected and removed so that the intended or authorized users can properly move their vehicle into the desired space while unauthorized users are prevented from entering the space.

Clearly it is undesirable that a barrier of this sort include a part which is removable since this must then be carried or stored in some suitable location and then replaced when it is required for use.

It is one object of the present invention, therefore, to provide a device which can be mounted in the surface of an area, for example a car park, a roadway or the like to be protected and which can provide a barrier which can be raised and lowered as required and yet maintain the integrity of the surface and security of the barrier equipment.

According to the invention, therefore, a security barrier device comprising an elongate container with a pair of sides, a pair of ends interconnecting the sides and an open top, a post member having a length and width less than that of the container so that in a first position thereof it can lie in the container along the length of the container, mounting means connecting to the post adjacent one end thereof and to the container adjacent a respective end thereof coupling said post to said container for pivotal movement relative thereto from the first position to a second position in which the post extends from the container in a direction substantially at right angles thereto, cover means for said container mounted on said container for movement relative thereto from a closed position in which it can cover said container and said post in said first position of said post and in which it can cover said container and provide an opening through which said post can project in said second position of said post, to an open position in which it allows said pivotal movement of said post, and locking means arranged so as when locked to lock said post in said second position thereof.

According to a second aspect of invention there is provided a security barrier device comprising an elongate container having a pair of sides, a pair of ends interconnecting the sides and an open top, a post member having a length and width less than that of the container such that in a first position thereof it can lie in the container along the length of the container, mounting means connected to the post adjacent one end thereof and to the container adjacent to a respective end thereof coupling said post to said container for limited sliding movement and for pivotal movement of the post relative to the container from the first position to a second position in which the post extends from the container in a direction substantially at right angles thereto, said mounting means including latching means into engagement with which said post can slide relative to said container to retain said post in said second position, cover means for said container mounted on said container for movement relative thereto from a closed position in which the cover means covers said container and said post in said first position of the post and in which said cover means covers said container and provides an opening through which said post can project in said second position of said post, to an open position in which said cover means allows said pivotal movement of said post, locking means for locking said cover means in said closed position, and cooperating abutment means on said post and on said cover means for retaining said post against said sliding movement out of said latched condition when said cover means is in said closed position thereof whereby to lock said post in said second position thereof.

The invention has the advantage, therefore, that the barrier itself is maintained in the container which is mounted in the ground in horizontal condition with the cover providing a substantially complete cover for the container and which can be locked in a closed condition or opened to allow the barrier to be raised and lowered. In addition, the locking of the cover automatically retains the barrier in the erected condition.

Preferably the locking mechanism is provided as a part of the container, and can be mounted on an outer surface of the container so that it is also buried in the ground and protected from vandalism. The single locking mechanism which locks the cover in place thus acts to secure the barrier when it is in the lowered condition and also to hold it in the erected condition.

The slide coupling between the post and the container advantageously allows the post to be moved laterally as it is pivoted to the erected condition so that it can fall into a recess in a bottom plate of the container to hold the post in the erected condition while it is locked into the latched condition by the downward movement of the cover into engagement with a tab on an outer surface of the post.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which.

DETAILED DESCRIPTION

Figure 1:
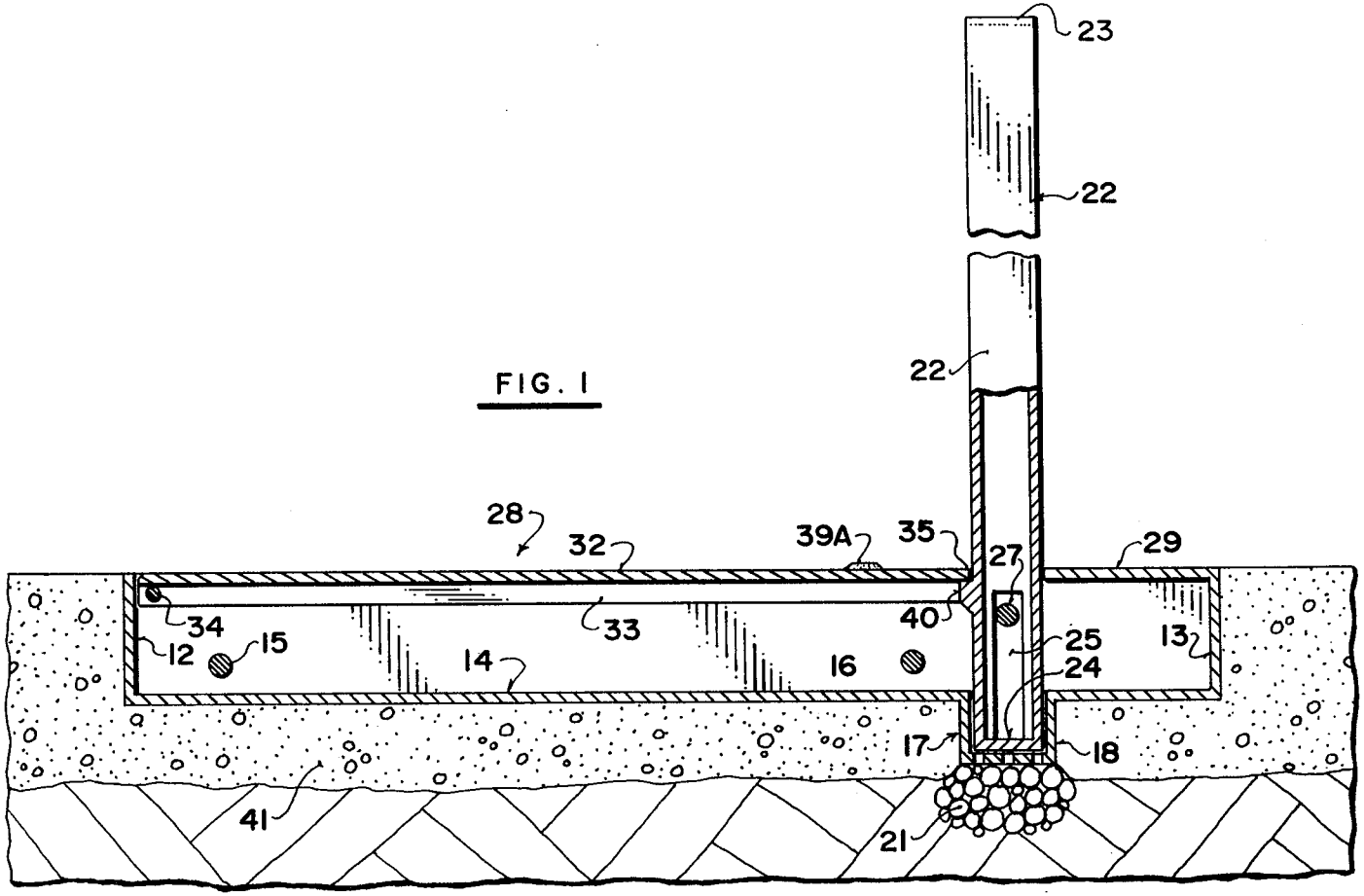
FIG. 1 is a longitudinal vertical cross section view of a security barrier device according to the invention.
Figure 2:
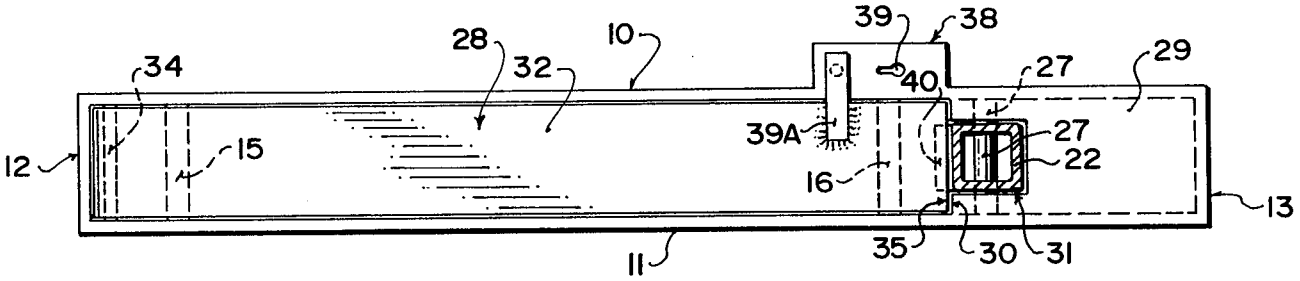
FIG. 2 is a top plan view of the device of FIG. 1.

In the drawings like characters of reference indicate corresponding parts in the different figures.

The device comprises a container in the form of an elongate box having sides 10 and 11, ends 12 and 13 and a substantially flat base 14 all of which are formed from rigid metal preferably steel welded together to form a rigid box. The box has a substantially open top. In one example, the box might be of the order of 36 inches length and 4 inches in width. Two additional strengthening pins 15 and 16 are welded across the inside of the box at a position spaced from the bottom of the box below the centre line thereof.

Adjacent the end plate 13, the base plate 14 includes a recess 17 which is formed with four sides 18 arranged at right angles and a transverse base 19 parallel to the plate 14. The recess thus defines a rectangular area downwardly of the plate 14. The base 19 includes one or more holes 20 which act as a drainage for the container where any water entering the container can escape via the recess and the holes 20 into a drainage area 21 beneath the container.

The device further includes a post 22 which is formed of a rectangular tube cut to a length which may be in one example 33 inches and provided with upper and lower end caps 23 and 24. Prior to applying the end cap 24, a slot arranged transverse to the post is formed in the post by cutting into two parallel sidewalls thereof from the lower most end longitudinally toward the other end over a limited extent, the slot being indicated at 25. The end cap 24 when applied acts to close the slot at the lower end with the upper end of the slot being closed by a transverse end 26. A pin 27 is welded across the interior of the container from the sidewall 10 to the sidewall 11 so as to extend through the slot 25. The pin thus captures the post 22 within the container but allows sliding movement defined by the length of the slot and pivoting movement of the post about the pin and thus relative to the container.

A cover for the container is formed in two parts indicated at 28 and 29 respectively. The cover part 29 is welded to the upper edge of the sides 10 and 11 and the end plate 13. The cover part 29 extends from the plate 13 to a position directly above the recess 17 and slightly beyond the pin 27. An outer most end of the cover part 29 is defined by a transverse edge 30. A recess 31 of the same cross sectional shape as the post 22 is cut in the cover part 29 extending from the edge 30 toward the plate 13 so as just to receive the post within its confines.

The cover part 28 is formed of an upper plate 32 and downwardly turned sides 33 which lie along the side edges of the plate 32 and are arranged at right angles to the plate 32. The sides 33 thus define flanges which in a closed position of the cover part lie just inside the sides 10 and 11 of the container. At one end of the flanges is provided a transverse pin 34 which connects the flanges to the sides 10 and 11 for pivotal movement of the cover part 28 relative to the container. The pin 34 is mounted at the end of the container remote from the post 22 that is adjacent the end 12. The edge of the cover part 28 remote from the pin 34 and indicated at 35 is arranged so that in a closed position of the cover part it lies directly adjacent and in contact with an adjacent side of the post 22.

A locking mechanism is mounted on an outer surface of the side 10 and is indicated at 38. The locking mechanism is formed within a container part welded on the outer face and having an upper surface flush with the upper edge of the side 10. The locking mechanism is mounted within that container but is not shown for convenience of the illustration and it will be appreciated that various locking mechanisms of different designs can be used. In this example a key opening is shown at 39 in the upper surface for actuating a lock bolt which moves in a horizontal direction longitudinal of the container. The cover part 28 includes a tab 34A which is welded to the upper surface thereof and extends outwardly to one side of the cover part 28 so as to overlie the locking mechanism 38. The tab carries a downwardly depending pin which corporates with the locking mechanism to cause locking of the tab into the locking mechanism and thus retains the cover part 28 in a closed position when the locking mechanism is actuated.

An abutment 40 is provided on a side of the post adjacent the cover part 28 and arranged so that with the cover part 28 closed the abutment 40 lies directly beneath the cover part and in engagement therewith.

Figure 3:
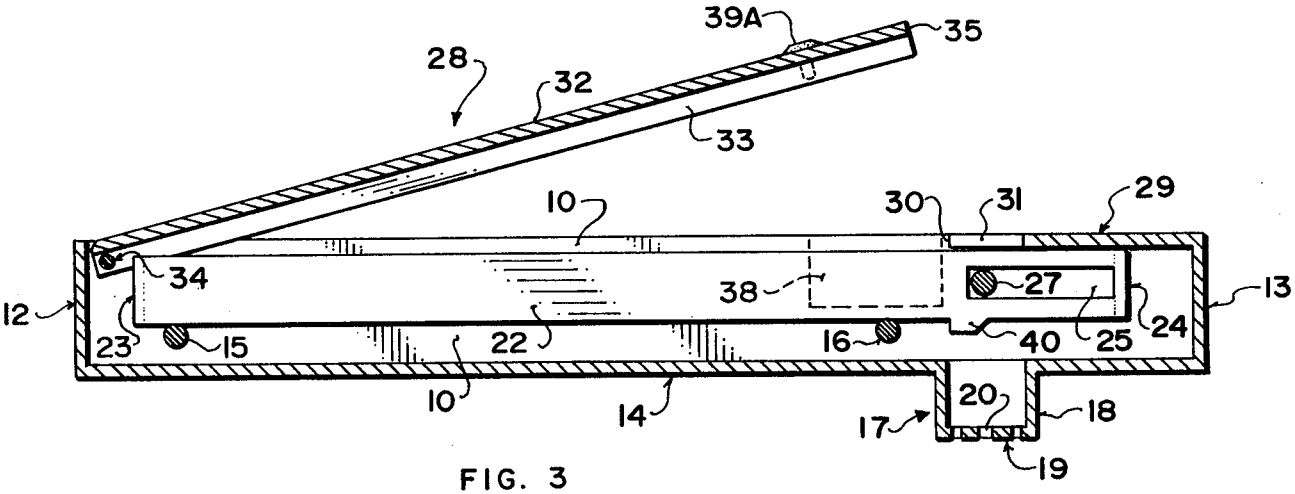
FIG. 3 is a cross sectional view similar to FIG. 1 showing the barrier post in a retracted condition and a cover plate in a raised condition.

In operation, the post 22 can be stored in a horizontal position within the container in the position shown in FIG. 3. In this position the lower end of the post and the end plate 24 thereof can be moved by a pivoting action to a position beneath the cover part 29 which remains fixed. The cover part 28 can then be closed over the retracted post, to complete the cover of the container, and locked into the closed position so as to retain the post securely within the container and separated from any improper action. The only opening in the cover with the cover part 28 closed is provided by the recess 31 which is of a small nature and which is directly underlied by an upper surface of the post thus preventing any entry of contamination or improper access. In this position the post, as shown in FIG. 3, lies on the transverse pins 15 and 16 and thus is held away from the base of the container so that it can be easily grasped.

As shown in FIG. 1, the container in operation of this device is embedded in a surface layer 41 which may be of concrete or other finishing material for a roadway, car park or the like. The drainage material 21 is positioned beneath the recess when the container is embedded so as to ensure proper drainage away from the container.

When it is required to erect the post into the raised position to act as a barrier, the cover part 28 is unlocked from the locking mechanism 38 and raised by pivotal movement about the pin 34 as shown in FIG. 3. In the raised or open condition of the cover part 28, the post can be grasped and pivoted about the pin 27 while a sliding movement is also provided by a movement of the pin 27 along the slot 25 so that the lower end of the post avoids engagement with the base of the container. When the post is fully raised and erected, it can be moved vertically downwardly by sliding movement of the pin 27 along the slot 25 so the lower end of the post engages into the recess 17 and is latched thereby in the raised or vertical position. Subsequently the cover part 28 can be lowered into its closed position and locked into place. This completes the covering of the container and again prevents entry of any contamination. At the same time the edge 35 of the cover part 28 engages the adjacent surface of the post 22 to hold it in place against any pivotal movement and to engage the abuttment 40 so as to prevent any vertical movement of the post out of the recess 17. In this way the post is locked into place merely by the locking of the cover part 28 and cannot be moved by an unauthorized person. The latching effect provided by the recess 17 grasps firmly the post 22 so that it is not held in position merely by the locking mechanism but by the rigid action of the pin 27 and the recess and hence he cannot be removed simply by an impact from a vehicle. Any such impact does not directly act upon the locking mechanism and hence the strength of the device is provided by the rigid metal parts rather than the locking mechanism itself.

The invention therefore provides a device which enables a vertical barrier to be raised simply and held in position effectively and yet the container for the post is provided directly at the post itself without the necessity for removal of the post and the container is readily closed against contamination or improper action by a simple locking mechanism.

Since various modifications can be made in my invention as hereinabove decribed, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. A security barrier device comprising an elongate container having a pair of sides, a pair of ends interconnecting the sides and an open top, a single post member having a length and width less than that of the container such that in a first position thereof it can lie in the container along the length of the container, mounting means connected to the post adjacent one end thereof and to the container adjacent to a respective end thereof coupling said post to said container for pivotal movement of the post relative to the container from the first position to a second position in which the post extends from th container in a direction substantially at right angles thereto, said mounting means being arranged to allow limited sliding movement of said post in said second position thereof in a direction longitudinal of the post, latching means fixed on said container arranged such that said sliding movement of said post causes said post to engage said latching means in a latched condition of the post to hold said post to prevent said pivotal movement, cover means for said container mounted on said container for movement relative thereto from a closed position in which the cover means covers said container and said post in said first position of the post and in which said cover means covers said container and provides an opening through which said post projects in said second position of said post, to an open position in which said cover means allows said pivotal movement of said post, and locking means for locking said cover means in said closed position, said post including a lug defining an abutment surface extending outwardly from one side thereof and arranged at a position along the length of the post such that, with the post in said latched condition in engagement with said latch means and said cover means in said closed position thereof, said cover means engages said abutment surface to hold said post against said sliding movement of said post out of said latched condition whereby to lock said post in said second position thereof.

2. The invention according to claim 1 wherein said locking means includes an actuable lock mechanism mounted on a side of the container.

3. The invention according to claim 2 wherein the said lock mechanism is mounted on an outer surface of a side of the container and wherein the cover means includes a tab member extending outwardly therefrom beyond said side of said container for engaging said lock mechanism.

4. The invention according to claim 1 wherein said cover means includes means pivotally mounting said cover means on said container at an end of said container remote from said respective end of said container, an end of said cover means remote from said pivot means being arranged for engagement with said post when in said second position.

5. The invention according to claim 1 wherein said mounting means is arranged at a position spaced from said one end of said post at a position spaced from said respective end of said container and wherein said cover means includes a part fixed to said container and extending from said post to said respective end.

6. The invention according to claim 1 wherein said container includes a bottom plate substantially closing a bottom defined by said sides and said ends and wherein said latching means comprises a recess in said bottom plate shaped to receive an end of said post an into which said post can descend for providing said latched condition of said post in said position.

* * * * *